US008371224B1

(12) United States Patent
Boswell et al.

(10) Patent No.: US 8,371,224 B1
(45) Date of Patent: Feb. 12, 2013

(54) VARIABLE YIELD DEVICE AND METHOD OF USE

(75) Inventors: Christopher Boswell, Alexandria, VA (US); Gerardo Pangilinan, Alexandria, VA (US); Von Whitley, Los Alamos, NM (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 579 days.

(21) Appl. No.: 12/315,489

(22) Filed: Nov. 26, 2008

(51) Int. Cl.
*F42B 12/02* (2006.01)
*F42B 12/20* (2006.01)
*F42B 3/22* (2006.01)

(52) U.S. Cl. ..... 102/475; 102/305; 102/318; 102/320; 102/322; 102/331; 102/217; 102/499

(58) Field of Classification Search ..... 102/475, 102/320, 332, 499, 217, 305, 318, 322, 331
See application file for complete search history.

(56) References Cited

U.S. PATENT DOCUMENTS

| | | | | |
|---|---|---|---|---|
| 2,697,400 | A | 12/1954 | Lilegren | |
| 3,100,445 | A | 8/1963 | Poulter | |
| 3,561,361 | A | 2/1971 | Kessenich et al. | |
| 3,707,917 | A | 1/1973 | Zernow et al. | |
| 4,384,527 | A | 5/1983 | Bugiel | |
| 4,658,727 | A * | 4/1987 | Wilhelm et al. | 102/494 |
| 5,198,615 | A | 3/1993 | Robbie et al. | |
| 5,221,810 | A | 6/1993 | Spahn | |
| 5,229,542 | A * | 7/1993 | Bryan et al. | 102/491 |
| 5,233,929 | A | 8/1993 | Spahn | |
| 6,352,029 | B1 * | 3/2002 | Guirguis et al. | 102/286 |
| 7,331,268 | B1 * | 2/2008 | Pangilinan et al. | 86/50 |
| 7,347,906 | B1 * | 3/2008 | Guirguis | 149/14 |
| 7,891,297 | B1 * | 2/2011 | Rohr | 102/492 |

* cited by examiner

*Primary Examiner* — James Bergin
(74) *Attorney, Agent, or Firm* — Fredric J. Zimmerman

(57) ABSTRACT

An apparatus and method for selectively varying the yield of an explosive device is provided. The apparatus generally comprises a main charge that may selectively be consumed and/or detonated to achieve the selected yield ranging from about 0% to about 100%.

12 Claims, 2 Drawing Sheets

VARIABLE YIELD DEVICE AND METHOD OF USE

GOVERNMENT LICENSING CLAUSE

The invention described herein may be manufactured and used by or for the Government of the United States of America for governmental purposes without the payment of any royalties thereon or therefore.

FIELD OF THE INVENTION

The present invention relates generally to ordnance, and more specifically to a device and method for increasing the yield of an explosive.

BACKGROUND OF THE INVENTION

Explosive ordnance typically has a yield—for example one ton, one kiloton, one megaton—to describe its explosive capability. More specifically, yield generally describes the total energy released in a charge's, ordnance's, munition's or the like's explosion, as usually measured by the amount of TNT necessary to cause a release of the same amount of energy. While ordnance has a yield rating, it can also have an effective yield as well. A 100% effective yield would mean that all of the main charge of that particular ordnance would be detonated. In this case that yield and the effective yield would be the same. For example, if you had a 10 kiloton weapon, and that weapon had a 100% yield, then the energy of 10 kilotons of TNT would be released upon the detonation of that weapon. In contrast, if that same 10 kiloton weapon had a 50% effective yield, then the energy output would be about 5 kilotons of TNT. In essence, then, the effective yield is the actual yield of the weapon, explosive, ordnance and the like. Ordnance typically has a single yield rating, with different size munitions being chosen for a mission based on the amount of TNT required to achieve a certain desired result. This result requires the production, storage and transport of ordnance of different physical size. It is desirable to maintain the flexibility afforded by having ordnance of differing yields while reducing the number of ordnance of differing physical size. Thus it is desired to have a variably selectable yield device.

SUMMARY OF THE INVENTION

The present invention may comprise one or more of the following features and combinations thereof.

In one illustrative embodiment, a variable yield device comprising: an energetic charge, an energy focusing guide, a main charge, and a main detonator is provided. The energetic charge and the guide are operatively joined to each other. Illustratively, the guide and the main charge are operatively joined to each other.

Also presented is an illustrative variable yield device comprising: a main charge, a deflagration assembly, and a detonation assembly, and wherein the main charge and the deflagration assembly are operatively coupled together, and wherein the main charge and the detonation assembly are operatively coupled together.

Further provided is an illustrative variable yield device comprising: a main charge, and a mitigation assembly operatively disposed to at least in part segment the main charge into a first volume and a second volume, and wherein the mitigation assembly comprises a detonation assembly and a deflagration assembly.

Also presented is an illustrative method of varying the yield of an explosive device comprising the steps of consuming a selective volume of a main charge, and detonating a selective volume of the main charge, and wherein the volume of main charge consumed and the volume of main charge detonated are selected to achieve a desired yield.

An illustrative method of manufacturing a variable yield device is also provided, the illustrative method comprising the steps of: positioning a detonation assembly in operative association with a portion of a main charge, and positioning a deflagration assembly in operative association with another portion of the main charge apart from the first portion.

These and other objects of the present invention will become more apparent from the following description of the illustrative embodiments.

DESCRIPTION OF THE ILLUSTRATIVE EMBODIMENTS

Figure 1:
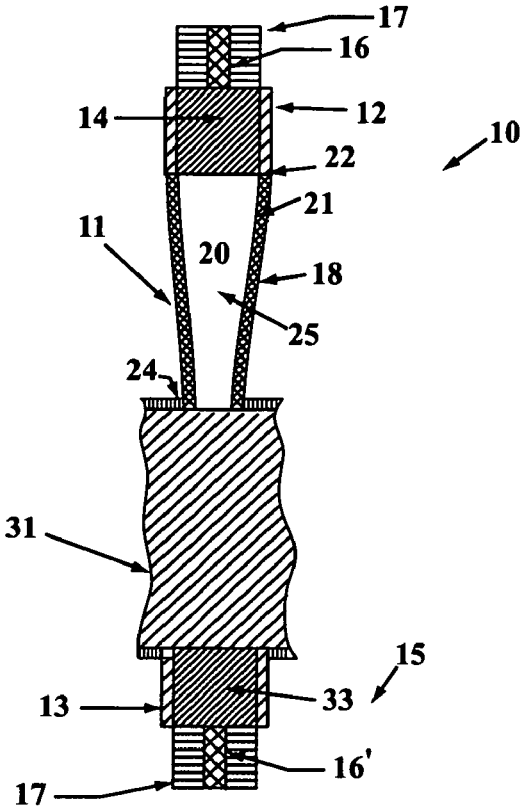
FIG. 1 is a side, cross-sectional view of an illustrative variable yield device.

For the purposes of promoting an understanding of the principles of the invention, reference will now be made to a number of illustrative embodiments illustrated in the drawings and specific language will be used to describe the same. In the illustrative drawings, like reference characters designate like or corresponding parts throughout the drawings. For similar but not identical parts, an alphabetic suffice (e.g., "A") is used. It should be noted, however, that the invention in its broader aspects is not limited to the specific details, representative devices and methods, and illustrative examples shown and described in this section in connection with the illustrative embodiments and methods. It is to be noted that, as used in the specification and the appended claims, the singular forms "a," "an," and "the" include plural referents unless the context clearly dictates otherwise.

Referring now more particularly to FIG. 1 there is shown an illustrative variable yield device 10. The illustrative device 10 generally comprises a deflagration assembly 11, also referred to as a deflagrator, a detonation assembly 15, and a main charge 31. The deflagration assembly 11 generally comprises an energetic charge 14, also referred to as a driver charge and/or a driver explosive, an energy focusing guide, also referred to as a guide element and/or a guide 18, and an energetic detonator or initiator 16. The detonation assembly 15 generally comprises a main detonator 16' or initiator and illustratively may further include an optional booster charge 33. The optional booster charge 33 may reside in an illustratively cylindrical booster housing 13. As will be seen, additional illustrative embodiments, depicted for example and without limitation in FIG. 2 and FIG. 3, substantially comprise these general elements. For example, the main detonator/initiator 16' and the driver detonator/initiator 16 may be substantially similar to one another in structure and operation in each of the illustrative embodiments 10/10A/10B as further described herein. Similarly, the structure and operation of the guide 18 is substantially the same throughout the illustrative embodiments 10 (FIGS. 1) and 10B (FIG. 4) and differs slightly in construction in the guide 18A of the deflagration assembly 11A of the illustrative embodiment 10A depicted in FIG. 2.

Illustratively, throughout the illustrative embodiments 10/10A/10B the energetic charge 14 or driver charge 14, may optionally be loaded in an optional driver housing 12. In the illustrative embodiments 10/10A/10B, the optional driver housing 12 illustratively may be included in the deflagration assembly and is shaped as a cylindrical shell having a closed top or proximal end 22, 22A (optionally with a central aperture (not shown)) and an open lower or distal end 24, 24A. The housing 12 may optionally contain a thin insulation layer. The deflagration assembly 11 and detonation assembly 15 illustratively may be operatively connected, for example and without limitation via wires 41, 44, 46, to one or more control units 43 and/or fuses 42.

The energetic charge or driver explosive 14, in the illustrative embodiments 10/10A/10B, is a pressable charge, although castable, pourable, or other charges may be used. The energetic charge 14 may include a nitrate-containing compound, and, in particular, an amount of at least about 90 weight percent, and, more particularly, at least about 94 weight percent of the total weight of the charge 14. The nitrate-containing compound may include one, two, three, or more nitrate groups (and, in particular, tri-nitro or higher), and may be selected, for example and without limitation, from one or more of the following: a nitramine, such as 1,3,5-trinitro-1,3,5-triaza-cyclohexane (RDX), 1,3,5,7-tetranitro-1,3,5,7-tetraaza-cyclooctane (HMX), and 2,4,6,8,10,12-hexanitro-2,4,6,8,10,12-hexaazatetracyclo-[5.5.0.0.sup.5,90-.sup.3,11]-dodecane (CL-20); a nitrate ester, such as, pentaerythritol tetranitrate (PETN), ethylene glycol dinitrate (EGDN), nitroglycerin (NG); and/or other nitrates, such as, trinitrotoluene (TNT), 1,3,5-triamino-2,4,6-trinitrobenzene (TATB), 1,1-diamino-2,2-dinitro ethane (DADNE), and 3-nitro-1,2,4-triazol-5-one (NTO); and others, such as 1,3,3-trinitroazetidine (TNAZ); and combinations.

The energetic charge 14 optionally may include additional ingredients, such as for example and without limitation, oxidizers, binders, curing agents, plasticizers, and less desirably, small amounts of metal (e.g., aluminum) and carbon fuel. Examples of oxidizers include nitrates and perchlorates, such as, ammonium perchlorate. Non-energetic binders, energetic binders, or a combination thereof may be used. The binder may be plasticized or unplasticized and may be selected from substituted or unsubstituted oxetane polymers, polyethers, and polycaprolactones. Representative binders that may be selected include, among others, hydroxy-terminated polybutadiene (HTPB), polypropylene glycol, polyethylene glycol, poly(glycidyl nitrate) (PGN), poly (nitratomethylmethyl-oxetane) ("poly-NMMO"), glycidyl azide polymer ("GAP"), diethyleneglycol triethyleneglycol nitraminodiacetic acid iterpolymer ("9DT-NIDA"), poly(bisazidomethyloxetane) ("poly-BAMO"), poly-azidomethyl-methyloxetane ("poly-AMMO"), nitrocellose, polybutadieneacrylonitrile acrylic acid terpolymer ("PBAN"), and combinations and copolymers thereof. The binder formulations will generally include a curative appropriate for the binder. For example, a polyisocyanate curing agent is often used with polyglycidyl nitrate, polyoxetanes, polyglycidyl azide, hydroxy-terminated polybutadienes, and polyethers, whereas an epoxy curing agent is generally used with other binders, such as, PBAN.

In one illustrative embodiment, the driver detonator or driver initiator 16 extends into an upper end of the driver housing 12 and illustratively resides in an annular housing 17. A portion of the illustrative initiator 16 is substantially adjacent to and operatively associated with the energetic charge 14. Similarly, the illustrative main detonator 16' also may reside in a generally annular housing 17, with at least a portion of the main detonator 16' being operatively associated with the main charge 31. In the illustrative embodiment where the detonator assembly includes a booster charge 33, the main detonator 16' would be operatively associated with the booster charge 33, which in turn would be operatively associated with the main charge 31.

Exemplary detonators/initiators 16, 16' include, for example and without limitation, standard fuse cords, blasting caps (e.g. RP80), electric matches with lead lines, and other known and/or suitable initiators and detonators. The detonator/initiator 16, 16' illustratively is capable of a remote activation to place the operator a safe distance from the explosive event of initiating or detonating the energetic charge 14. So, too, the fuse 42 alone or in conjunction with a control unit 43 may activate, energize or initiate the detonator/initiator 16, 16' in order to initiate or detonate the energetic charge 14 and/or the main charge 31 as desired to obtain a selective yield. The annular housing 17 illustratively may be made of various materials, including metallic, non-metallic, and composite materials. Acrylics comprise one exemplary suitable material.

Figure 2:
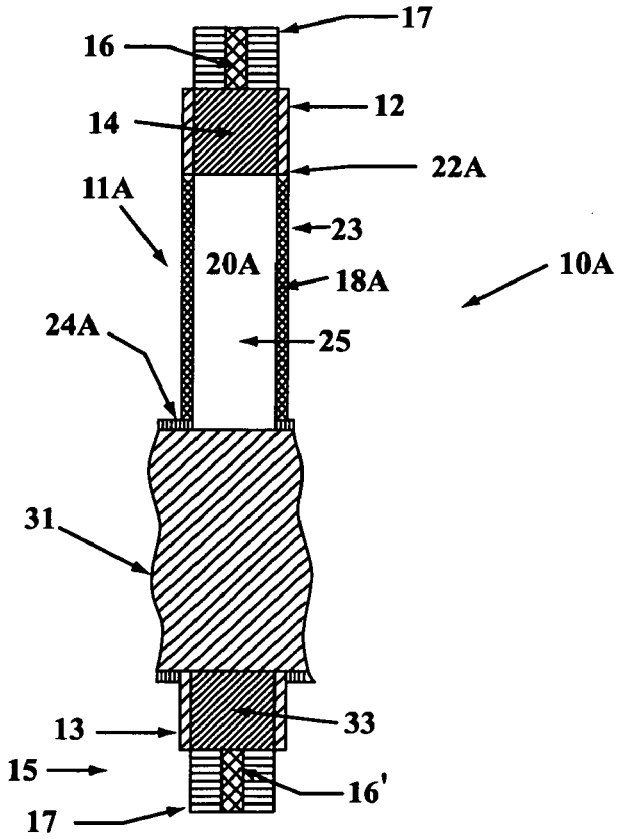
FIG. 2 is a side, cross-sectional view of another illustrative variable yield device.

The illustrative energy-focusing guide 18, 18A, also referred to as a shock guide and a guide element, is operatively associated with, joined, coupled, or connected to the energetic charge 14 for example and without limitation by being connected or operatively associated with the upper housing 12. The energy-focusing guide 18 includes an internal passageway 20, which extends through the energy-focusing guide 18. In particular, in FIG. 1, the upper housing 12, including the energetic charge 14, is intermediate the initiator 16 and the proximal end 22 of the energy-focusing guide 18. The cross-sectional dimension of the internal passageway 20, illustratively, may decrease (FIG. 1) or may remain constant (FIG. 2) from the proximal (top in FIG. 1) end 22 to the distal (bottom in FIG. 1) end 24 of the energy-focusing guide 18. In the illustrative embodiment shown in FIG. 1, the internal passageway 20 and an exterior surface 21 of the energy-focusing guide 18 illustratively tapers at a substantially constant rate from the proximal end 22 proceeding to the distal end 24. The proximal end 22 is substantially adjacent to and operatively associated with the energetic charge 14. In the illustrative device 10A shown in FIG. 2, the internal passageway 20A and an external surface 23 of the energy-focusing guide 18A remain substantially constant in dimension between the proximal end 22A and the distal end 24A. The proximal end 22A is substantially adjacent to and operatively associated with the energetic charge 14. In short, while the illustrative guide 18 is generally tapered, the illustrative guide 18A is generally cylindrical shaped. It should be understood that other cross-sectional profiles are possible, such as those comprising tapering and non-tapering portions, that is, cross-sectional dimensions of the internal passageway 20/20A may include decreasing portions and constant portions. In another embodiment, the internal passageway 20/20A, may taper at a non-constant rate proceeding from the proximal end 22/22A to the distal end 24/24A. It will further be appreciated that the internal passageway 20/20A and the exterior surface 21/23 may have cross sections that differ from one another. For example and without limitation, the external surface could have a substantially cylindrical cross section 23 as shown in FIG. 2, that remains substantially constant in dimension between the proximal end 22/22A and distal end 24/24A, while the internal passageway 20 tapers at a constant or non-constant rate proceeding from the proximal end 22/22A to the distal end 24/24A, and vice versa. In order to produce shock velocity sufficient to enhance yield as described herein, it is desirable that no region of the internal passageway 20/20A increases in cross-sectional dimension proceeding from the proximal end 22/22A to the distal end 24/24A.

The internal passageway 20/20A includes and generally is filled with fluid, for example an ionizable gas 25, which is a compressible, ionizable gas. Examples of suitable ionizable gases 25, include, but are not limited to, air, hydrogen, helium, argon, oxygen, and nitrogen, and combinations thereof. The gas 25 is generally maintained at atmospheric pressure, that is, about 1 ATM.

Figure 3:
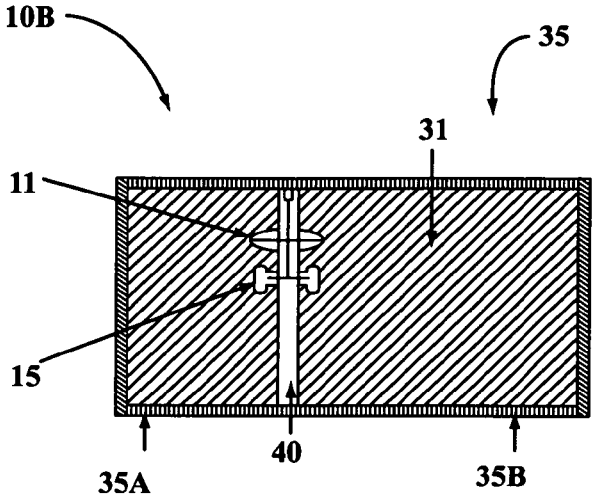
FIG. 3 is a side, cross-sectional view of another illustrative variable yield device.
Figure 4:
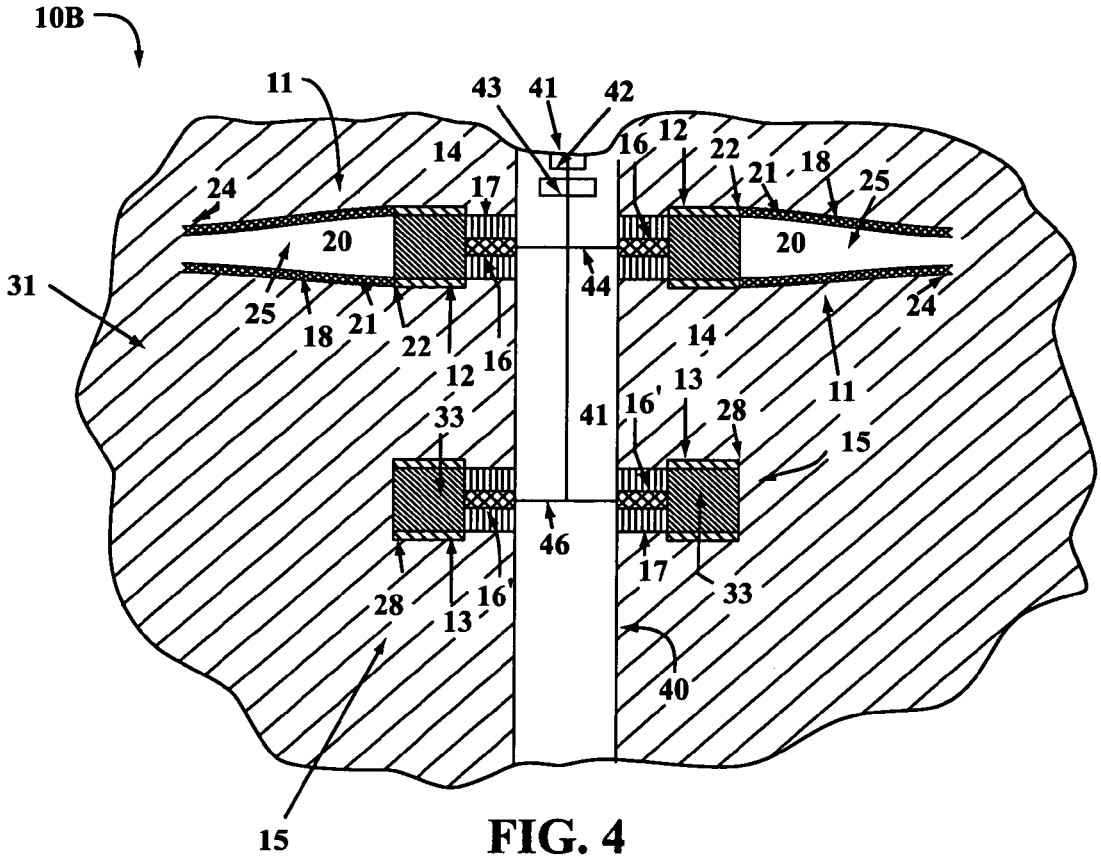
FIG. 4 is an fragmented enlarged view of the illustrative variable yield device of FIG. 3.

In one illustrative embodiment, a mitigation assembly 40 may be operatively associated with the main charge. Referring to FIG. 3 the illustrative mitigation assembly generally comprises a deflagration assembly 11 and a detonation assembly 15. Illustratively, the mitigation assembly 40 may comprise a plurality of deflagration assemblies 11 and/or a plurality of detonation assemblies 15. Referring to FIG. 4, it will be appreciated that the one or more deflagration assemblies 11 and the one or more detonation assemblies 15 of the mitigation assembly 40 illustratively and generally comprise the same components as illustrated in FIGS. 1 and 2 and as described herein. Although not shown in FIG. 3 or 4, the one or more of the deflagration assemblies 11 of the mitigation assembly may have alternate shapes and cross-sections, for example and without limitation, the cylindrical guide 18A depicted in FIG. 2 could be used, as could any other suitable shaped guide. The mitigation assembly 40 may also comprise a control unit 43. The control unit 43, which may comprise one or more fuses 42, may be in operative communication with the deflagration assembly 11 via for example signal lines 41, 44, and in operative communication with the detonation assembly 15 via for example signal lines 41 and 46.

As depicted in FIG. 3, the mitigation assembly 40 may segment or partially segment the volume 35 of the main charge into sub-volumes 35A and 35B. The sub-volumes 35A/35B may be of any selected size and proportion to allow selection of a desired yield from a set of yields. For example, the main volume 35 may be segmented or divided into 50%/50%, 60%/40%, 70%/30%, 80%/20%, 90%/10%, 95%/5% and etc. sub-volumes. In one illustrative embodiment (FIG. 3), the main volume 35 is divided into 30% 35A and 70% 35B volumes. Not only can the sub-volumes be selected to afford the choice of various yields, but, so, too, the main volume 35 could be segmented into additional sub-volumes. For example, main volume 35 could be segmented into three sub-volumes, four sub-volumes, five sub-volumes and so on as desired. Indeed, the main volume 35 could be segmented into N volumes, wherein N is any positive integer. The number of mitigation assemblies 40 would be represented by N−1. For example, the illustrative embodiment of FIG. 3 has two volumes 35A and 35B, and one mitigation assembly 40. However, each of the mitigation assemblies 40 need not be alike. Each sub-volume must have at least one deflagration assembly and one detonation assembly operatively associated therewith. Looking at the illustrative embodiment of FIG. 3, the mitigation assembly 40 illustratively comprises two each of the deflagration and detonation assemblies such that one deflagration assembly and one detonation assembly is operatively disposed or associated with respective sub-volumes. It will be apparent that further segmenting the main volume 35 into another sub-volume (not shown) would require a mitigation assembly 40 to comprise only a single deflagration assembly and a single detonation assembly since only the new sub-volume would lack such assemblies 11, 15. Of course, the additional mitigation assembly illustratively could comprise a pair of deflagration assemblies 11 and a pair of detonation assemblies 15 such that one of the sub-volumes 35A/35B would be operatively associated with a deflagration assembly and a detonation assembly from each of two mitigation assemblies 40 for a total of two deflagration assemblies and two detonation assemblies. Those skilled in the art will realize that the mitigation assembly 40 or assemblies could be disposed to fully petition the volume 35, or the volume 35 could be participated using any other suitable means. So, too, the mitigation assembly 40 need not perform any partitioning. For example, the illustrative embodiment of FIG. 3 could be partitioned using a wall or other suitable partition or barrier, and one mitigation assembly could be operatively associated with one of the sub-volumes, for example at the top, bottom, midst or end thereof, and another mitigation assembly, and another mitigation assembly could be operatively associated with the other of the sub-volumes at the top, bottom, midst or end thereof.

The fuse or fuses 42 may comprise any electrical or mechanical fuse or combination thereof known to those skilled in the art. Examples of suitable fuses include for example and without limitation the following series: M904, MK 339, MK 376, FMU-152, FMU-143, FMU-139, FMU-140 and the like commonly used in conjunction with numerous bombs and other ordnance. It will be appreciated that the disclosed embodiments need not be restricted in their use to standard ordnance and may in fact be adapted for use with any explosive device or ordnance.

Illustratively, a yield multiplying or reactive material (not shown) may be placed at the distal end 24/24A of the guide 18/18A. Such a reactive material will be chosen such that it is generally inert, but energetically reactive when impacted by sufficient energy. Suitable reactive materials include for example and without limitation, alone or in combination with other materials, rubber, polyethylene, polytetrafluoroethylene (e.g., TEFLON), and certain metals.

Referring to FIGS. 1, 2 and 3, the housings 12, 13, 17 and the energy-focusing guide 18/18A may be made of the same or different materials, including, for example, metals, alloys, plastics, composites, paper and pulp products, etc. Illustratively, the materials selected may generally be compatible with the intended use environment (e.g., high or low temperature, maritime, under water etc.) of the device 10/10A/10B.

In operation, upon activating, energizing or initiating the detonator or igniter 16, the energetic charge 14 in the upper housing 12 is detonated, generating or releasing a shockwave, also referred to as a deflagration wave or deflagration front. Without wishing to be bound necessarily by any theory, one contends that the shockwave passes through gas contained in the energy-focusing guide 18 to compress, heat, and accelerate the gas 25 in the direction of the shockwave front motion. The shockwave has an initial "detonation velocity." Detonation velocity is measured for the purposes of this invention in accordance with the technique set forth in John M. McAfee, Blaine W. Asay, A. Wayne Campbell, John B. Ramsay, Proceedings Ninth Symposium on Detonation, OCNR 113291-7 pp. 265-278 (1989). Examples of detonation velocities for many compositions are set forth in Navy Explosive Handbook: Explosive Effects and Properties Part III, 1998. The shockwave proceeds generally away from the driver explosive or energetic charge 14 and into the guide 18, which guides and focuses the shockwave on to the main charge 31. The shockwave creates a rapid pressure and heat insult which interacts with the main charge 31 in order to ignite the main charge 31 and cause it to deflagrate or be consumed generally beginning in the area operatively joined, coupled or adjacent to the proximate end 24, 24A.

As the shockwave passes through the guide 18/18A and encounters the gas 25, the shockwave may slow somewhat. If the shockwave passing through the guide 18/18A has an effective velocity to excite gas molecules into a reactive transition state, the gas 25 begins to undergo exothermic decomposition and enters into a plasma state. The velocity needed to generate plasma will depend primarily upon the ionization potential of the gas 25 contained in the energy focusing guide 18/18A. Gas ionization potentials are reported in the CRC Handbook of Chemistry and Physics. For example, in the case of air, the detonation velocity is generally at least about 7 mm/msec (millimeters per microsecond) and the effective velocity of the shockwave is generally about 6 mm/μsec at a temperature of at least about 10,000° C., and more particularly, at least about 20,000° C. to about 50,000° C., and even more particularly, at least about 50,000° C., where higher velocities are produced respectively. Other gases may have higher or slower ionization potential and require different effective velocities. Accordingly, in other embodiments, the detonation velocity may equal the effective velocity, alternatively the detonation velocity may be greater than the effective velocity or possibly, the detonation velocity may be equal to or less than the effective velocity.

Advantageously, the construction of the device 10, 10A, 10B requires small amounts of energetic charges to achieve the desired enhancement. For example, according to one experimental test, detonating about 160 grams of explosive 14 and focusing the resultant shockwave and explosive products through a substantially constantly tapering guide 18 of about six inches in length, into impact with a piece of rubber material 32 about one inch thick, creates temperatures in excess of about 6700° C. and about $1\times10^{22}$ charged electrons per cubic meter compared to about 1800 to about 2800° C. and no charged electrons for the same event conducted without the reactive material 32. Thus, for example and without limitation, the same amount of explosive could be used to produce a quicker rate of consumption of the main charge 31. So, too, a lesser amount of explosive could be used to create substantially the same rate of consumption. Similarly, explosive ordnance with less energetic material could be used to create a similar energy release in a safer and less sensitive warhead.

The velocity of the shockwave as it passes through the gas 25 may be measured as follows. Fiber optic cables with a core diameter of 250 μm are passed perpendicular to the length of the guide 18/18A through both walls of the guide 18/18A. One end of the fiber is connected to a laser and the other end is connected to a silicon photodiode. The fiber that is inside the guide 18/18A has the low-index cladding removed, resulting in a fiber that is exposed to the atmosphere in the guide. Since the index-of-refraction of the atmosphere in the guide, initially air at ambient pressure, is considerably lower than the index-of-refraction of the fused silica core of the fiber, almost all of the laser light coupled to the fiber will remain in the fiber as is passes through the guide. However, when the higher-pressure shock wave passes by the fiber, the index-of-refraction of the air increases to the point that light begins to escape the fiber. This action results in a measurable decrease in detected laser light as the shockwave passes the fiber optic. By placing a series of fiber optics at known locations along the length of the guide, the shock velocity in the guide can be calculated by dividing distance the fiber is from the energetic by the arrival time of the shock at the fiber.

Without wishing to be bound by any theory, one contends that the energy-focusing device 18/18A is primarily responsible for increasing the efficiency of ionization and polarization of the gas 25 so that smaller amounts of energetic charge are required. As the shockwaves and hot explosive gases from the energetic material 14 are propagated down the interior passageway 20/20A of the shock guide 18/18A, the gas 25 is compressed and the energy is applied to a smaller volume of gas. The compressed gas 25 undergoes greater local heating and ultimately decomposes to atoms and then the atoms become ionized into positively charged atoms and negatively charged free electrons within the shock guide 18/18A to a greater degree. Additionally, the guide 18/18A confines the charges and plasma allowing time for the charge separation to occur without them dissipating to the ambient atmosphere on the outside of the guide 18/18A. The configuration of the energy-focusing guide 18 efficiently captures and channels energy of the plasma in a deflagration wave or deflagration front on the main charge 31, which, without wishing to be bound by any theory, it is believed, causes the deflagration or consumption of the main charge 31. Deflagration is a very fast burning mechanism where the burn rate increases as a function of time. The deflagration burns or consumes a selected volume, amount or portion of the main charge 31, which consumed volume is not available for detonation, thereby decreasing the yield. Illustratively, as noted, if a reactive material is positioned between the shock guide 18/18A, then the deflagration turns the reactive material into a gas thereby releasing the energy contained therein, which released energy is combined with that of the energetic charge 14 to increase the rate of consumption of the selected volume of the main charge 31. It will be appreciated that consumption of the selected volume of the main charge could be achieved by other appropriate means known to those in the art. For example, a chemical reaction could be used, for example and without limitation a pyrotechnic device such as a thermite device could be initiated to consume the desired amount of main charge 31. In addition, a different type of charge, for example and without limitation a shaped charged could be used to generate the deflagration wave.

The illustrative detonation assembly 15 functions in a conventional manner. For example, the main detonator or initiator 16' is initiated or energized to start the detonation train, wave or front. In the event that a booster charge 33 is included, it will be initiated or exploded to add energy to the detonation front. The detonation front will eventually fire or initiate the main charge 31, or that portion of the main charge 31 not consumed by the deflagration front in the case of the illustrative embodiments of FIGS. 1 and 2, and that portion of the main charge 31 segmented in operative association with the detonator assembly in the case of the illustrative embodiments of FIGS. 3 and 4. The detonator or initiator 16, 16' may be initiated or energized by for example and without limitation a signal from the control unit 43, based on any desired event, logic or parameter including for example and without limitation the passing of a period of time, a specified atmospheric pressure, a specified hydrostatic pressure, a specified proximity to a target, a specified external temperature, a specified mechanical time, a specified internal pressure, a specified internal temperature and the like. By consuming or deflagrating a selected portion, volume or amount of the main charge 31 and detonating or exploding the remaining portion, volume or amount of the main charge 31, a scaleable or variable yield device illustratively is realized. The selectively variable yield illustratively ranges from about 0% to about 100%. If all of the main charge 31 is consumed, the yield would be about 0%. If all of the main charge 31 is detonated, the yield would be about 100%. In the illustrative embodiment of FIGS. 1 and 2, substantially this entire range of yields is available. Without wishing to be bound by any theory, it is thought that the deflagration wave is initiated to consume a selected portion or volume of the main charge 31 as described, and the detonation wave is initiated to detonate the remaining portion or volume of the main charge 31. Illustratively, the deflagration and detonation waves of such a device would be generally in opposition to one another and would. In addition, timing of the initiation of the generally opposing waves, which would control how much of the main charge is consumed and how much is detonated, would be controlled, for example by the control unit (not shown in FIG. 1 or 2) to achieve the desired yield. For example, if the deflagration wave is allowed to proceed to consume all of the main charge 31, then the yield would be about 0%. Illustratively, if the deflagration wave or front consumed about 75% of the main charge 31 and the remaining 25% was detonated, the yield would be about 25%. Further illustratively, if the deflagration front and the detonation front meet generally in the middle of the main charge 31, the yield would be about 50%. If the deflagration front consumed about 30% of the main charge and the detonation front detonated the remaining about 70% of the main charge, the yield would be about 70%. If the detonation front detonates all of the main charge 31, the yield would be about 100%. It should be apparent that the yield is not only fully scalable, but can also be changed by merely changing the timing of the control signals used to initiate or energize the detonators 16, 16'.

In contrast to the fully scalable illustrative embodiment, is the illustrative embodiment of FIGS. 3 and 4, where the amount of main charge 31 to be consumed and the amount of main charge to be detonated is determined not so much by timing as by the amount segmented in operative association, communication, joinder, coupling, or connection with the respective initiator 16, 16' or deflagration assembly 11 or detonation assembly 15. As an illustrative example, the illustrative embodiment of FIG. 3 has a volume 35 that is split, segmented, compartmented and like into two sub-volumes 35A/35B or amounts of main charge. One sub-volume 35A illustratively comprises about 30% of the explosive weight or volume of the main charge 31, and the other sub-volume 35B illustratively comprises the remaining about 70% of the explosive weight of the main charge 31. Selectively detonating and/or deflagrating these sub-volumes 35A/B leads to varying yields. It has been found that completely deflagrating the device 10B produces a free field pressure output of about 10%, accordingly, energizing both deflagration assemblies operatively adjacent to—which is also referred to herein throughout and vice versa as coupled, connected, and/or associated with and/or disposed in—the selected segmented volumes 35A/B produces a yield of about 10%. Further illustratively: detonating both segmented volumes 35A/B produces a yield of about 100%; consuming or deflagrating the first volume 35A and detonating the second volume 35B produces a yield of about 73%; and detonating the first volume 35A and consuming the second volume 35B produces a yield of about 37%. As noted, by changing the volume of each of the sub-volumes and/or by further segmenting the main charge 31 into additional volumes will allow for the selection of a greater number or different set of yields as desired.

The variable yield device 10, 10A, 10B may be manufactured in any appropriate manner. One such illustrative method for manufacturing the device 10, 10A, 10B includes inserting the detonator/initiator 16, 16' through an aperture in the closed end of the housing 17. Adhesives, mechanical fasteners, tape, or the like may be used to retain the initiator 16, 16' in place. The housing 17 illustratively is coupled generally with a hermetic seal, to the energy-focusing guide 18/18A, to the booster charge 33, and/or to the housing 12 using adhesive (e.g., epoxy), mechanical fasteners, or the like. Assembling the components as described forms the respective deflagration assembly 11 and the respective detonation assembly 15, which can be combined to form the mitigation assembly 40. The order of assembly, for example and without limitation the order for inserting the initiator 16, 16', loading the charge 14, and coupling the energy-focusing guide 18/18A, is not particularly important, and may be practiced in any sequence.

The neutralizing device and method of the present invention have a wide range of utilities. Additional advantages and modifications will readily occur to those skilled in the art upon reference to this disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents. Any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A variable yield device, comprising:
- an energetic charge;
- a guide;
- a main charge;
- a main detonator;
- an energetic detonator;
- housing structures;
- a booster charge being disposed between the main charge and the main detonator;
- and
- a control unit,
  - wherein the energetic charge and the guide are operatively joined to each other,
  - wherein the guide and the main charge are operatively joined to each other,
  - wherein the energetic detonator is operatively connected to the energetic charge,
  - wherein the main detonator is operatively connected the main charge,
  - wherein the control unit is operatively connected to both the energetic detonator and the main detonator and configured to vary, selectively a yield of the device,
  - wherein the guide is a hollow guide,
  - wherein the guide includes a proximal end adjacent the energetic charge and a distal end adjacent the main charge, and
  - wherein the energetic charge, the main charge and the booster charge are enclosed in the housing structures.

2. The device of claim 1, wherein a portion of said housing structures and said energetic charge are operatively joined to the guide.

3. The device of claim 1, wherein said energetic detonator and said control unit are operatively connected to the energetic detonator and to the main detonator to control the initiation of each of the energetic detonator and the main detonator to achieve a selected yield.

4. The device of claim 3, wherein the main detonator and the energetic detonator are generally disposed in opposing relation to one another such that a detonation front and a deflagration front are initiated in general opposition such that the main charge is consumed from a first end toward a second end and detonated from the second end toward first end.

5. The device of claim 1, wherein the yield of the device is selectable between about 0% and about 100% yield.

6. The device of claim 1, wherein the control unit comprises a mechanical fuze.

7. The device of claim 1, wherein the control unit comprises an electrical fuze.

8. The device of claim 1, wherein the control unit comprises an electrical fuze and a mechanical fuze.

9. The device of claim 1, wherein the control unit initiates a detonation signal to energize the main detonator to achieve a yield of about 100%.

10. The device of claim 1, wherein the control unit initiates a deflagration signal to energize the energetic detonator and a detonation signal to energize the main detonator at a selected period of time after the energetic detonator is energized.

11. The device of claim 10, wherein the control unlit initiates a deflagration signal to energize the energetic detonator and a detonation signal to energize the main detonator at a selected period of time after the energetic detonator is energized, and wherein the selected period of time is chosen to allow a portion of the main charge to be consumed prior to the detonation of a remainder of the main charge not consumed in order to achieve the selected yield ranging from about 0% to about 100%.

12. The device of claim 1, wherein the guide generally tapers from the proximal end to the distal end.

* * * * *